US009609896B2

(12) United States Patent
Crosby

(10) Patent No.: US 9,609,896 B2
(45) Date of Patent: Apr. 4, 2017

(54) PERFORMANCE ENHANCED WATER SOCK

(71) Applicant: Stacey D. Crosby, Payne, OH (US)

(72) Inventor: Stacey D. Crosby, Payne, OH (US)

( * ) Notice: Subject to any disclaimer, the term of this patent is extended or adjusted under 35 U.S.C. 154(b) by 602 days.

(21) Appl. No.: 13/766,047

(22) Filed: Feb. 13, 2013

(65) Prior Publication Data

US 2013/0152275 A1 Jun. 20, 2013

Related U.S. Application Data

(63) Continuation of application No. 12/577,254, filed on Oct. 12, 2009, now abandoned.

(60) Provisional application No. 61/196,057, filed on Oct. 14, 2008.

(51) Int. Cl.

| | |
|---|---|
| ***A41B 11/00*** | (2006.01) |
| ***A41B 11/12*** | (2006.01) |
| ***A43B 5/08*** | (2006.01) |
| ***A43B 13/22*** | (2006.01) |

(52) U.S. Cl.

CPC ..... *A41B 11/004* (2013.01); *A41B 11/008* (2013.01); *A41B 11/123* (2013.01); *A43B 5/08* (2013.01); *A43B 13/22* (2013.01)

(58) Field of Classification Search

CPC ... A41B 11/004; A41B 11/123; A41B 11/008; A43B 13/22; A43B 5/08

USPC ... 2/239, 409, 240, 241, 242, 161.6; 36/114, 36/8.1, 94, 106, 8.3

See application file for complete search history.

(56) References Cited

U.S. PATENT DOCUMENTS

| | | | | |
|---|---|---|---|---|
| 962,089 | A * | 6/1910 | Newton | 2/240 |
| 1,330,315 | A | 2/1920 | Hagan | |
| 1,724,450 | A | 8/1929 | Callahan | |
| 2,075,229 | A | 3/1937 | Rose | |
| 2,332,252 | A * | 10/1943 | Payne | 36/106 |
| 3,274,709 | A * | 9/1966 | Lipinski | 36/10 |
| 3,417,408 | A * | 12/1968 | Caggiano | 2/239 |
| 3,605,292 | A * | 9/1971 | Goldblatt | 36/8.1 |
| 4,476,858 | A * | 10/1984 | Curtis | 602/23 |
| 5,054,129 | A | 10/1991 | Baehr | |
| D375,195 | S | 11/1996 | Panassidi | |
| 5,617,585 | A | 4/1997 | Fons et al. | |
| 5,623,734 | A | 4/1997 | Pugliatti | |
| 5,749,100 | A | 5/1998 | Rosenberg | |
| 5,867,838 | A | 2/1999 | Corry | |
| 5,960,565 | A | 10/1999 | Lochbaum | |
| 6,083,602 | A | 7/2000 | Caldwell et al. | |
| 6,226,800 | B1 | 5/2001 | Islar | |
| 6,247,182 | B1 * | 6/2001 | Tasbas | 2/239 |

(Continued)

OTHER PUBLICATIONS

REI, How to choose socks, Mar. 28, 2013.*

(Continued)

*Primary Examiner* — Khaled Annis

(74) *Attorney, Agent, or Firm* — Faegre Baker Daniels LLP

(57) ABSTRACT

A water sock forming a tubular body having a pair of opposing, open ends that allow the water sock to be put on and removed as easily as any sock. The simple design of this water sock makes it compatible with any type of outer footwear. In one exemplary embodiment, a stretchable toe strap extends between opposing sides of the water sock adjacent to one of the open ends. This toe strap is received between two of the wearer's toes during use and prevents the water sock from sliding rearward toward the wearer's heel.

12 Claims, 6 Drawing Sheets

(56) References Cited

U.S. PATENT DOCUMENTS

| | | | | |
|---|---|---|---|---|
| D476,147 | S | 6/2003 | Campbell | |
| 7,107,626 | B1 * | 9/2006 | Andrews | 2/239 |
| D548,951 | S | 8/2007 | Paulin | |
| 7,310,894 | B1 | 12/2007 | Schwarzman et al. | |
| 7,784,115 | B1 * | 8/2010 | Nemcik | 2/239 |
| 2002/0111575 | A1 | 8/2002 | Smith et al. | |
| 2003/0106129 | A1 | 6/2003 | Kim | |
| 2004/0025372 | A1 | 2/2004 | Watanabe | |
| 2005/0091729 | A1 * | 5/2005 | Alley | 2/239 |
| 2005/0092260 | A1 | 5/2005 | Paxton et al. | |
| 2005/0144703 | A1 | 7/2005 | Hilbert | |
| 2006/0179549 | A1 | 8/2006 | Huggins et al. | |
| 2006/0195972 | A1 | 9/2006 | Alley | |
| 2006/0196078 | A1 * | 9/2006 | Terlizzi et al. | 36/8.3 |
| 2007/0197112 | A1 | 8/2007 | Mazor et al. | |
| 2008/0060118 | A1 * | 3/2008 | Stuart | 2/240 |

OTHER PUBLICATIONS

Coega Sunwear, p. 1, http://www.coegasunwear.com/index2.html, at least as early as Oct. 8, 2009.

Non-Final Office Action dated Oct. 3, 2011 in U.S. Appl. No. 12/577,254.

Amendment dated Feb. 3, 2012 in U.S. Appl. No. 12/577,254.

Final Office Action dated Feb. 23, 2012 in U.S. Appl. No. 12/577,254.

Amendment After Final dated Jul. 23, 2012 in U.S. Appl. No. 12/577,254.

* cited by examiner

PERFORMANCE ENHANCED WATER SOCK

CROSS-REFERENCE TO RELATED APPLICATION

This application is a continuation of U.S. patent application Ser. No. 12/577,254 entitled PERFORMANCE ENHANCED WATER SOCK, filed on Oct. 12, 2009, the entire disclosure of which is expressly incorporated herein by reference.

This application claims the benefit under Title 35 U.S.C. §119(e) of U.S. Provisional Patent Application Ser. No. 61/196,057, entitled "Performance enhanced water sock", filed on Oct. 14, 2008, the entire disclosure of which is expressly incorporated by reference herein.

BACKGROUND

1. Field of the Invention

This invention generally relates to footwear and more particularly to a water sock.

2. Description of the Related Art

Along with water activities comes the risk of falling on slippery surfaces. The problem with slipping on wet surfaces is especially acute for children, seniors and anyone performing aquatic activities for recreational or therapeutic use. To overcome this problem, water shoes have been used in conjunction with various water related activities. For example, U.S. Pat. No. 7,310,894 describes a non-slip shower shoe. Additionally, U.S. Pat. No. 5,960,565 describes an aquatic exercise shoe with drainage holes and elastic straps to secure the shoe to the wearer's foot.

A water shoe generally accumulates and absorbs water that creates resistance and obstructs the natural motion of the wearer's foot, which makes swimming or kicking difficult and sometimes impossible for children, for example. Additionally, a water shoe may not fit the wearer's foot securely, which may lead to slipping. Further, the wearer does not have the ability to feel the slippery surface below and, therefore, fails to receive any tactile feedback that the wearer may take into account in navigating a slippery surface. Finally, while a water shoe is sufficient for protecting the foot from directly contacting fungus, during showering, for example, the foot is neglected.

Although prior art water shoes fulfill their specific objectives, the need remains for a non-slip device effective in diminishing the risk of slipping without hindering the natural motion of the foot during the respective water activity. Additionally, within a medical environment, the need remains for an anti-microbial device that allows a patient to safely walk to the shower, remain on their feet while showering, and safely get back to the hospital bed, for example, without ever being removed, all while providing a non-slip sole to diminish the risk of slipping and having anti-microbial properties which serve as a deterrent from bacteria, odor, and fungus.

SUMMARY

The present invention provides an open-toed water sock. Embodiments of the water sock of the present invention may provide various benefits either alone or in combination with one another. For example, in exemplary embodiments, the water sock of the present invention may be lightweight, may not accumulate significant amounts of water, may be anti-microbial, may allow for the wearer's foot to move freely in both an aquatic and non-aquatic environment, may create little resistance in an aquatic environment, may provide a non-slip surface, and may remain securely on the wearer's foot during an active motion like swimming or kicking, for example. As a result, the present invention facilitates the promotion of safety within and around water, such as during any water sport, water aerobic exercise, showering, surfing, sand sports, or any active motion of a recreational or therapeutic nature. The water sock of the present invention may be used in any aquatic environment, such as showers, pools, spas, water parks, or beaches.

In one exemplary embodiment, the water sock of the present invention forms a tubular body having a pair of opposing, open ends that allow the water sock to be put on and removed as easily as any sock. The simple design of this water sock makes it compatible with any type of outer footwear. In one exemplary embodiment, a stretchable toe strap extends between opposing sides of the water sock adjacent to one of the open ends. This toe strap is received between two of the wearer's toes during use and prevents the water sock from sliding rearward toward the wearer's heel.

In exemplary embodiments, the water sock of the present invention may be made of easy care materials, much like a swimsuit, which are both durable and long lasting. In one exemplary embodiment, the water sock is made from a blend of durable, expandable fabrics such as nylon and Lycra® brand fiber. "Lycra" is a registered trademark of Invista North America S.a.r.L., of Wilmington, Del. In exemplary embodiments, silver coated nylon fibers, charcoal and/or bamboo fibers may be added to provide an antimicrobial barrier that deters fungus, bacteria and odor.

In one exemplary embodiment, the water sock of the present invention is designed to cling securely to the wearer's foot, while allowing the wearer's foot to move naturally with little resistance through water. For example, the water sock of the present invention may be made of a stretchable fabric that is designed to be resiliently deformable, such that it will expand to accommodate a wearer's foot and will contract against the surface of the wearer's skin to position the water sock securely on the wearer's foot. As a result, the water sock of the present invention functions in a similar manner as the wearer's skin as it moves through the water, while simultaneously providing an additional layer of protection to the wearer's foot. Additionally, by using a water sock, as opposed to a water shoe that has a stiff or heavy sole, proper fit of the water sock to an individual wearer's foot is ensure and, consequently, the likelihood of the wearer slipping is decreased.

By forming the water sock of the present invention from a resiliently deformable material, the water sock of the present invention can be easily slipped on and off of the wearer's foot and does not have to be removed for the wearer to actively engage in a water related activity, such as swimming or water aerobics, for example. In addition to providing footwear that allows the wearer to actively engage in water related activities without the fear that the footwear may become dislodged from the wearer's foot, the water sock of the present invention also provides a non-slip sole that allows the user to seamlessly pass from wet to dry surfaces. In one exemplary embodiment, the non-slip sole of the water sock of the present invention is comprised of a soft, flexible polymer material applied on pressure points like the heel and ball of the foot. This protects the bottom of the wearer's foot from damage or injury caused from contact with an exposed surface. Additionally, the non-slip sole of the water sock also lessens the rate of wear of the bottom of the water sock, which extends the useful life of the water sock.

As indicated above, water shoes make swimming and other water activities dangerous by accumulating water that creates resistance and obstructs the natural motion of the foot. The water sock of the present invention is designed to allow natural motion of the foot and the open toes allow the wearer to feel more of the surface below, allowing the sensation of the water around them, without hindering the water activity in which they are participating. In addition, the open toes allow for the wearer to tactile feedback from their toes, which enhances the wearer's ability to navigate a wet or slippery surface.

In one form thereof, the present invention provides a water sock including an elongate tubular body formed from a first material have a top, a bottom, a foot engaging portion and a heel engaging portion. Each of the foot engaging portion and the heel engaging portion define an open end. The open ends of each of the heel engaging portion and the foot engaging portion are defined by a circumferential band. The circumferential band defining the open end of the foot engaging portion has a toe strap extending between opposing sides thereof. The bottom of the body has a ball region and a heel region. The water sock also includes a plurality of slip resistant regions formed from a second material. The plurality of slip resistant regions is positioned on the bottom of the body such that the first material underlies the plurality of slip resistant regions, wherein the first material and the second material are different. The first material is formed from a combination of nylon and spandex and the second material is formed at least partially from a polymer and may have grit incorporated therein.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION

Figure 1:
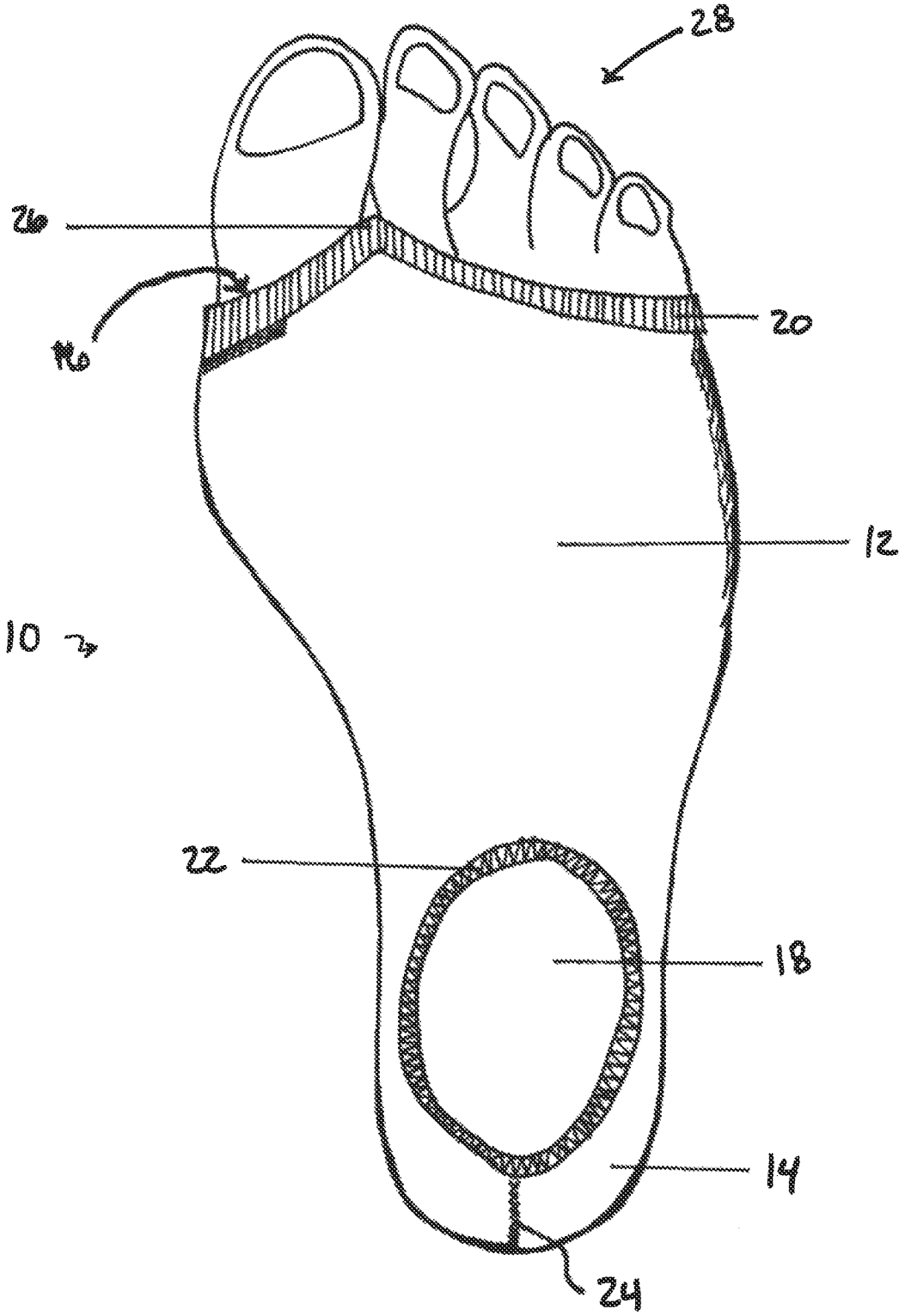
FIG. 1 is a plan view of a water sock according to an exemplary embodiment of the present invention further depicting an individual user's foot positioned therein.

Referring to FIGS. 1-4, water sock 10 is shown according to an exemplary embodiment of the present invention. Water sock 10 is formed as a substantially tubular, elongate body and includes foot engaging portion 12 and heel engaging portion 14. In one exemplary embodiment, foot engaging portion 12 and heel engaging portion 14 cooperate to form a substantially L-shape. Foot engaging portion 12 and heel engaging portion 14 terminate in open ends 16, 18, respectively. Open ends 16, 18 are defined by circumferential bands 20, 22, respectively, which provide additional securement to retain water sock 10 on an individual wearer's foot as described in detail below. Heel engaging portion 14 may be reinforced by creating seam 24, which extends upward from the bottom of heel engaging portion 14 and terminates at circumferential band 22. Circumferential bands 20, 22 and reinforcement seam 24 may be formed from a stretchable material, such as those described in detail below with reference to forming water sock 10, to allow for the proper amount of give during movement of a wearer's foot and to secure water sock 10 to a wearer's foot.

Figure 2:
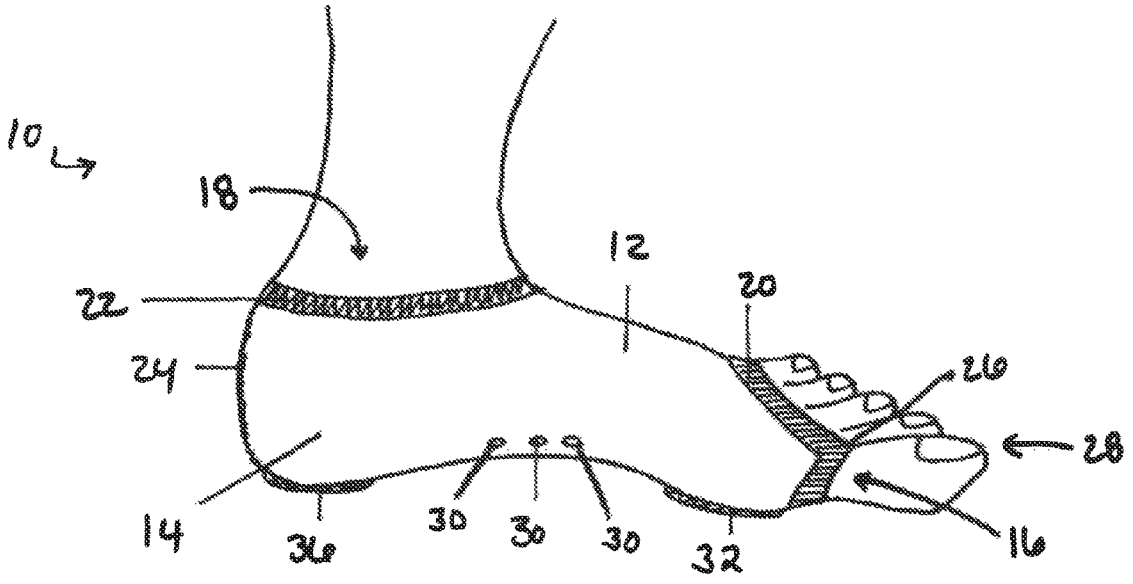
FIG. 2 is a right, elevational view of the water sock of FIG. 1.
Figure 3:
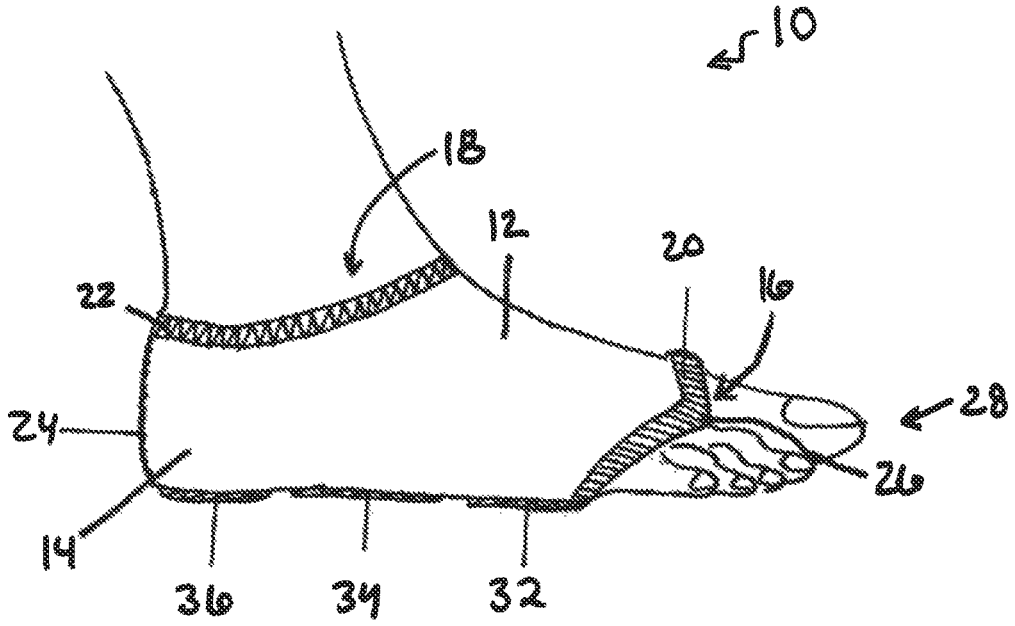
FIG. 3 is a left, elevational side view of the water sock of FIG. 1.
Figure 4:
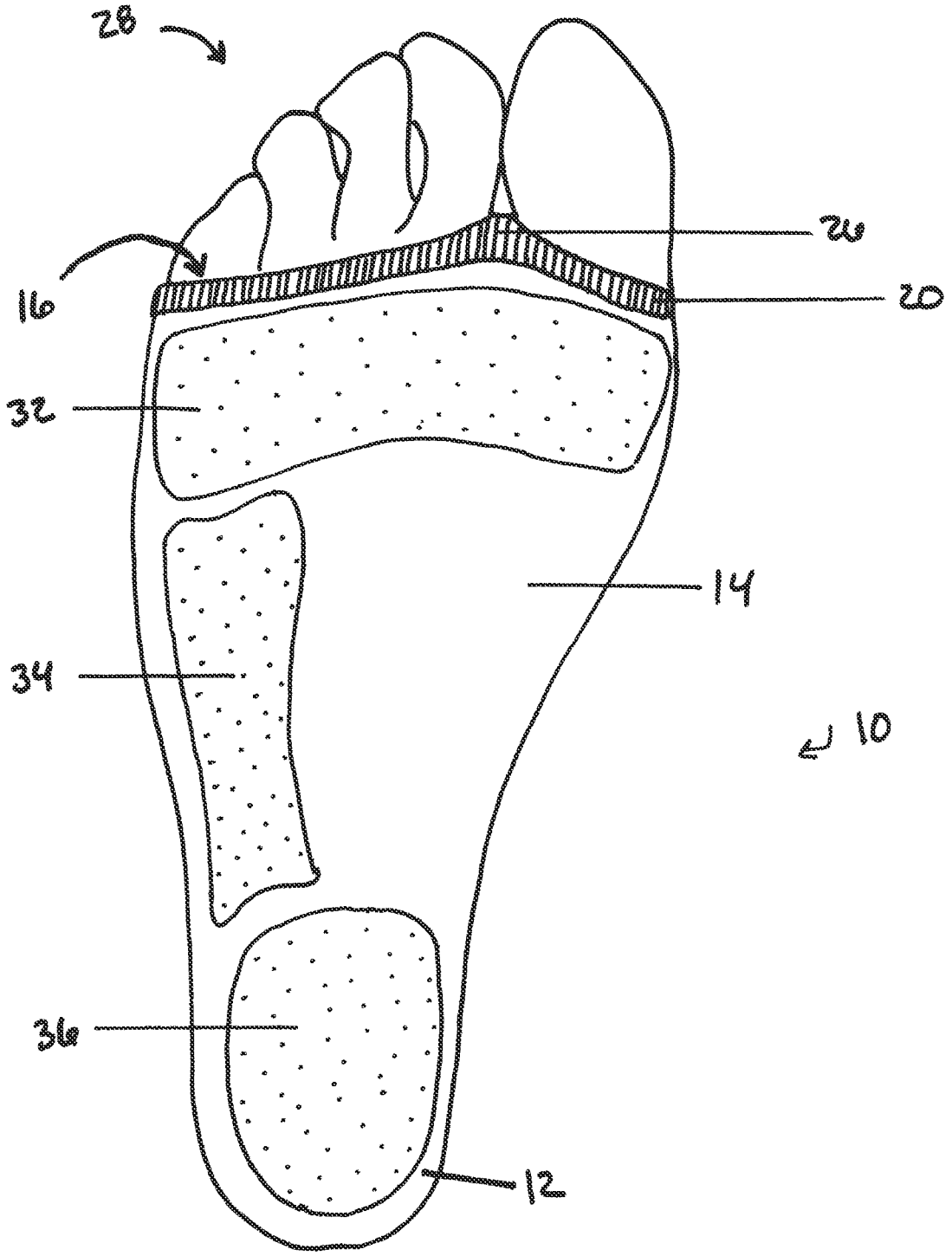
FIG. 4 is a bottom view of the water sock of FIG. 1.
Figure 6:
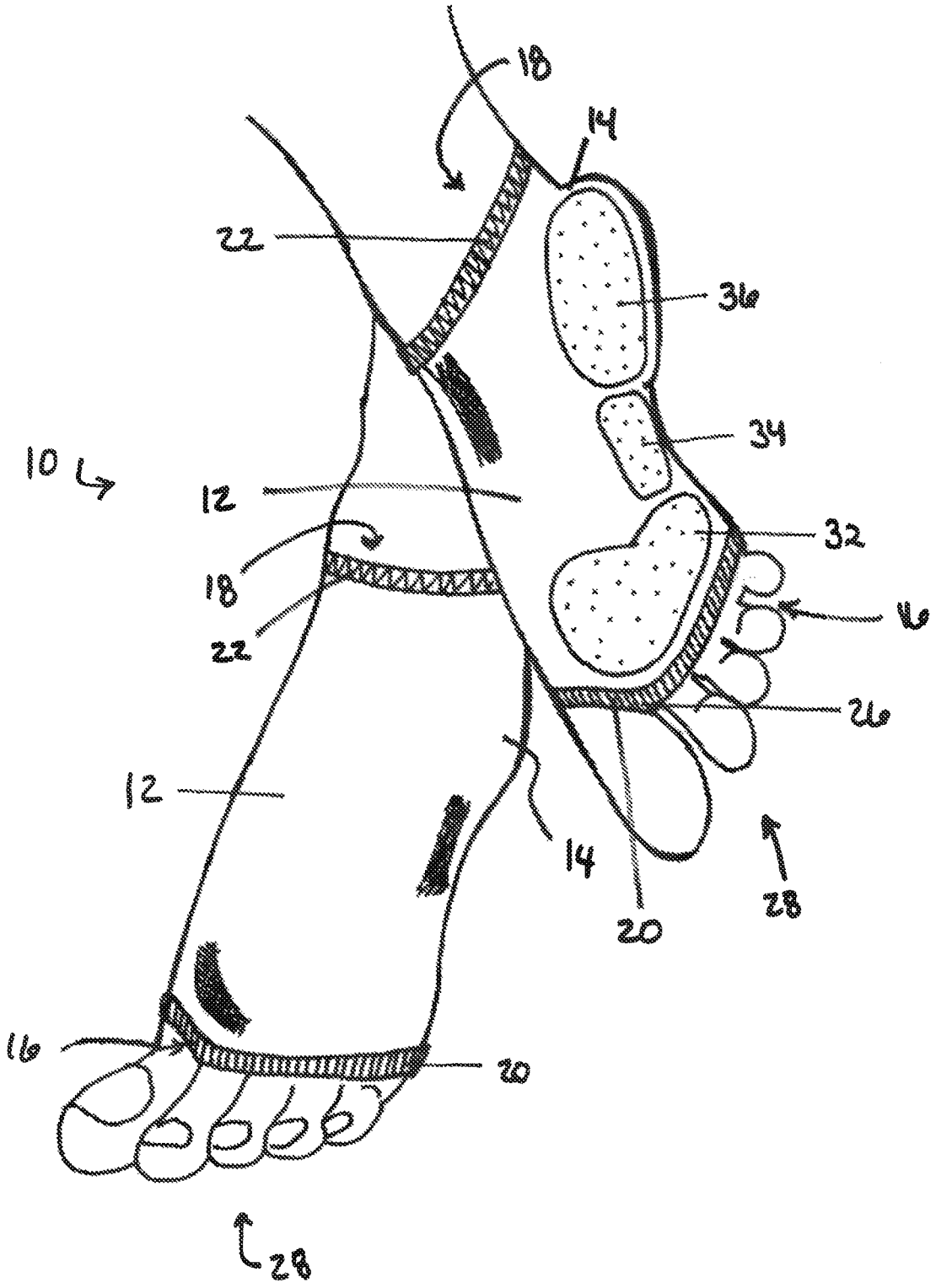
FIG. 6 is a perspective view of a pair of water socks of FIG. 1 positioned on an individual user's feet.

Toe strap 26 extends between and is secured to opposing sides of circumferential band 20 and, as shown in FIG. 4, creates two separate openings at open end 16 for the wearer's toes to pass through. Toe strap 26 is strategically positioned to extend between two of an individual wearer's toes 28 when water sock 10 is received on the wearer's foot. When positioned between an individual wearer's toes 28, toe strap 26 contacts the wearer's foot and prevents water sock 10 from advancing further in the direction of the wearer's ankle wherein, as shown in FIGS. 2, 3, and 6, the open end 18 of the heel engaging portion lies beneath the ankle joint of a user whereby, in use, the ankle joint is exposed. In one exemplary embodiment, circumferential band 20 forms an angled toe line, as shown in FIG. 1, in which opposing portions of circumferential band 20 extend gradually in a direction toward toes 28 and away from heel engaging portion 14 until reaching toe strap 26. This allows for a more natural and comfortable feel when water sock 10 is positioned on a wearer's foot.

Referring to FIG. 2, in one exemplary embodiment, openings 30 are formed in foot engaging portion 12 of water sock 10. Openings 30 allow for liquids and/or gases, such as water and air, to be expelled from the interior of water sock 10. Openings 30 may be formed in foot engaging portion 12 using traditional methods, such as sewing, stitching, or knitting, and may be formed during the formation of foot engaging portion 12 and water sock 10, as described below. Additionally, the periphery of foot engaging portion 12 that defines openings 30 may also be reinforced to prevent damage to foot engaging portion 12 and to allow openings 30 to expand as necessary to accommodate an individual wearer's foot.

Water sock 10 may be formed by any or any combination of knitting, stitching, weaving, or sewing. Preferably, water sock 10 is woven or knitted from a blend of materials, either natural or synthetic. For example, water sock 10 may be formed from a combination of cotton, a polychloroprene, such as Neoprene™ polychloroprene, nylon or polyester, i.e., polyethylene terephthalate or PET, for durability and a spandex, such as Lycra® brand fiber, for expandability. "Neoprene" is a trademark of Dupont Performance Elastomers of Wilmington, Del. In one exemplary embodiment, water sock 10 is formed from as little as 65 percent, 70 percent, or 80 percent and as much as 85 percent or 90 percent of at least one of cotton, polychloroprene, nylon, or polyester. In one exemplary embodiment, water sock 10 is formed from as little as 10 percent, 15 percent, or 20 percent and as much as 25 percent, 30 percent, or 35 percent spandex fibers.

By forming water sock 10 using at least 10 percent spandex fiber and no more than 35 percent spandex fiber, the desired amount of stretch will be provided to water sock 10. Specifically, water sock 10 will have an amount of stretch that is substantially within a range of 25 percent to 40 percent. Thus, water sock 10 will be able to expand such that the periphery of the material forming water sock 10 has a surface area that is 25 percent to 40 percent greater than when the material forming water sock 10 is in an unexpanded or natural state. By forming water sock 10 of a material that allow for an amount of stretch that is substantially within a range of 25 percent to 40 percent, water sock 10 will cling to the wearer's foot and will be retained securely on the wearer's foot. In certain embodiments, this "clinging" effect will actually be enhanced when the material is wet ensuring that water sock 10 is maintained in its desired position even during vigorous aquatic activities. In one exemplary embodiment, water sock 10 is formed from a blend of 85 percent nylon and 15 percent Lycra® brand fiber. This combination of materials is also sufficient to provide an amount of stretch that is substantially within the range of 25 percent to 40 percent.

Advantageously, the use of a nylon/spandex blend, for example, provides a two-way stretch capability that allows the material forming water sock 10 to move freely and to spring back into its original shape immediately. Stated another way, the use of a nylon/spandex blend makes water sock 10 resiliently deformable, such that water sock 10 will expand to accommodate a wearer's foot and will contract against the surface of the wearer's skin to position the water sock securely on the wearer's foot. Further, any seam construction, as may be necessary for the formation of water sock 10, is performed using a polyester, nylon, or thread of a stretchable nature, for example, that creates a durable seam using a flatlock stitch, for example. In addition to providing for the expansion of water sock 10, the use of spandex also provides water sock 10 with a resistance to sunlight, body oils, and other chemicals, such as chlorine. In addition to the combination of materials set forth above, the use of nylon may be supplemented by using silver coated nylon fiber or by using charcoal fibers, bamboo fibers, and/or other natural fibers that provide water sock 10 with an antimicrobial, UV protecting barrier.

Similarly, circumferential bands 20, 22 and toe strap 26 of water sock 10 may be formed separately from the general body of water sock 10, which is described in detail above. In exemplary embodiments, circumferential bands 20, 22 and toe strap 26 are formed from reinforced fabric or elastic materials, such as any of the materials set forth above with respect to the construction of water sock 10 either alone or in combination with one or more of each other. In exemplary embodiments, toe strap 26, which forms a bridge between opposing sides of open end 16 and may be connected to circumferential band 20, may be sewn or stitched in a conventional manner. In one exemplary embodiment, toe strap 26 is formed during the formation of the main body of water sock 10 and is formed as a unitary component of water sock 10, which eliminates the need to use seamed construction to form toe strap 26.

Referring now in detail to FIG. 4, the bottom of water sock 10 is shown, which includes ball region 32, mid-sole region 34, and heel region 36. Ball region 32, mid-sole region 34, and heel region 36 of water sock 10 are positioned on the ball, mid-sole, and heel portions, respectively, of an individual wearer's foot when water sock 10 is properly positioned thereon. Regions 32, 34, 36 are configured and strategically positioned to compliment the natural motion of the human foot. For example, regions 32, 34, 36 are positioned in areas of the human foot that act as contact points during walking or other natural movements.

Regions 32, 34, 36 of water sock 10 are formed as slip resistant regions on the bottom of water sock 10. In one exemplary embodiment, each of regions 32, 34, 36 have an articulated structure and a thickness that does not exceed 3/16 of an inch. This allows regions 32, 34, 36 to have high flexibility and high stretchability. In one exemplary embodiment, regions 32, 34, 36 are formed from an elastomeric polymer. For example, in one exemplary embodiment, the polymer is heat and/or melted and positioned on regions 32, 34, 36, such that the polymer interdigitates with the material forming water sock 10. Then, once the polymer cools, the polymer is securely bonded to the material forming the bottom of water sock 10 adjacent to regions 32, 34, 36. In another exemplary embodiment, the polymer may be formed as a sheet that is stamped or otherwise processed to have a desired shape, such as the shape of each of regions 32, 34, 36. Then, the polymer may be secured to the material forming the bottom of water sock 10 in any known manner, such as by ultrasonic welding.

In other exemplary embodiments, the polymer material used to form regions 32, 34, 36 has an enhanced slip resistance that is achieved by adding a grit material to the polymer. In exemplary embodiments, the grit material is one of or a combination of sand, silicon carbide, and aluminum oxide. By adding a grit material to the polymer, the surface area of regions 32, 34, 36 is increased and the friction generated between a contacting surface, such as the ground, and regions 32, 34, 36 is correspondingly increased. As a result, the slip resistance of regions 32, 34, 36 and water sock 10 is increased.

In one exemplary embodiment, regions 32, 34, 36 have a non-skid, textured surface that is formed by creating deviations in the thickness of the material, which results in the surface of the material forming an undulated surface. In one exemplary embodiment, regions 32, 34, 36 are formed from Toughtek® fabric, which is a fifty-percent cotton, fifty-percent polyester, flexible, drapable, abrasion-resistant fabric coated with polyvinyl chloride. "Toughtek" is a registered trademark of Harrison Technologies, Inc., of Broadalbin, New York. In another exemplary embodiment, regions 32, 34, 36 are formed from a 100% polyester knit, stretchable fabric, coated with a textured coating of Neoprene® polychloroprene. In one exemplary embodiment, regions 32, 34, 36 have a thickness of at least substantially 1/32 inch and no more than substantially 3/16 inch.

Additionally, while depicted as being form from a substantially continuous material, regions 32, 34, 36 may be formed from a material that intermittently covers the area defined by regions 32, 34, 36, such as by a series of projections. For example, in one exemplary embodiment, a series of separate, individual dot-shaped projections are formed in regions 32, 34, 36 from a polymer material. These projections may be formed by placing a discrete amount of melted and/or liquid polymer at specific locations within regions 32, 34, 36. The polymer will then cool and/or set, bonding the polymer to the material of water sock 10. In another exemplary embodiment, the material forming regions 32, 34, 36 may be sprayed on, such as by forming an aerosol, or may be secured using an adhesive, such as an epoxy. Regions 32, 34, 36 may also be secured to water sock 10 using any other known method, such as sewing or stitching.

While described and depicted herein as having three distinct regions of enhanced slip resistance, i.e., regions 32, 34, 36, any of regions 32, 34, 36 may be used singularly or in different combinations with one another. For example, in one exemplary embodiment, regions 32, 36 are present on water sock 10, while region 34 is absent. In addition, the position and orientation of sole regions 32, 34, 36 may be modified to cover different areas of the bottom of water sock 10.

In contrast with known water shoes, the use of regions 32, 34, 36 formed according to any of the methods and from any of the materials set forth herein results in the bottom of water sock 10 being lightweight and flexible. Additionally, unlike known water shoes, regions 32, 34, 36 do not inhibit the natural movement of a wearer's foot during aquatic activities.

Water sock 10 may be positioned on a wearer's foot in a substantially identical manner as a normal sock. Specifically, an individual wearer of water sock 10 advances their toes 28 through open end 18 of heel engaging portion 14 and passes their toes 28 out of open end 16 of foot engaging portion 12. As shown in FIG. 1, the individual wearer may pass a portion of their toes 28 through open end 16 on a first side of toe strap 26 and may pass the remaining toes 28 through open end 16 on a second, opposing side of toe strap 26. As shown in the accompanying figures, such as FIG. 1, four of the individual wearer's toes on a lateral side of the individual's body are positioned on a first side of toe strap 26 and the remaining toe on the medial side of the individual's body is positioned on the second side of toe strap 26. While toe strap 26 is depicted herein as separating open end 16 into two discrete openings that individually accommodate four of the wearer's toes and one of the wearer's toes, respectively, toe strap 26 may be position to create two distinct opening that individually accommodate any number of the wearer's toes.

Once in the position shown in FIGS. 1-6, water sock 10 is properly positioned and securely retained on the individual user's foot. Specifically, as shown in FIGS. 1-3, circumferential bands 20, 22 encircle the wearer's leg and foot to secure water sock 10 thereto. Circumferential band 22 is positioned to encircle the wearer's leg near the ankle, while circumferential band 20 encircles the wearer's foot near toes 28 and allows toes 28 to extend outwardly beyond circumferential band 20. Circumferential bands 20, 22 provide an increased thickness of stretchable or elastic material that is resiliently deformable and provides an area of increased strength that facilitates the retention of water sock 10 on a wearer's foot, as described above.

Figure 5:
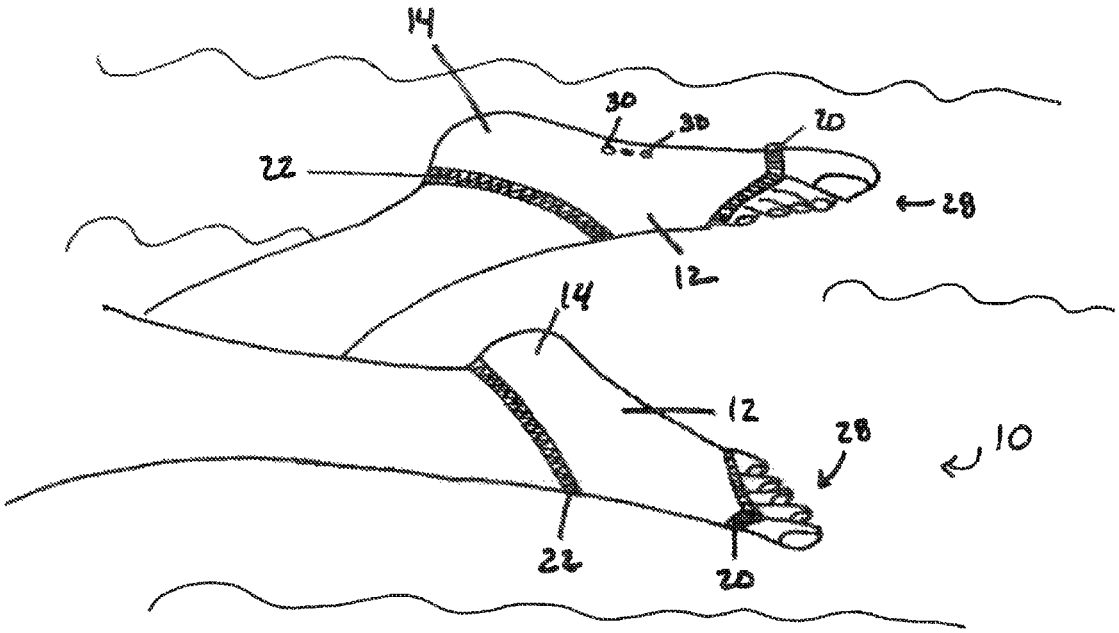
FIG. 5 is a perspective view of a pair of water socks of FIG. 1 positioned on an individual user's feet while the user engages in active motion under water.

Advantageously, in exemplary embodiments, the water sock 10 of the present invention clings to the foot of the wearer when wet, has a flexible, lightweight sole portion including an open toe region that cooperatively articulates, flexes, stretches or otherwise moves to provide a wearer with the sensation of feeling the surface below the toes, and provides the wearer's foot a natural, full range of motion in the variable conditions therein during any aquatic activity, such as swimming as shown in FIG. 5.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A water sock, comprising:

an elongate sewn tubular body formed from a first resiliently stretchable fabric material having a top, a bottom, a foot engaging portion and a heel engaging portion, each of said foot engaging portion and said heel engaging portion defining an open end, said open end of said heel engaging portion being formed in said first material and including a heel band, said heel band dimensioned and permanently shaped to lie beneath the ankle joint of a user and, in use, to securingly engage a user's foot beneath the ankle joint of a user whereby the user's ankle joint is exposed;

the top and bottom of the first material at said open end of said foot engaging portion being sewn together to thereby form a toe strap extending between opposing sides thereof thereby creating two discrete openings adapted to separate the big toe from the remaining toes of a wearer, said bottom of said body having a ball region and a heel region;

said first material adapted to cling to a wearer's foot;

a circumferential toe band on said open end of said foot engaging portion surrounding said two discrete openings and joined at said toe strap and being formed in said first material and dimensioned and permanently shaped to be angled about said toe strap both in use and in non-use of the water sock and, in use, to securingly engage a user's foot about respective locations at which the user's toes are joined to the user's foot;

said heel band and said toe band providing an increased thickness of elastic material, relative to said first material, about a user's heel and toes to facilitate retention of the water sock on the user's foot;

said first material including at least one seam connecting cut portions of the first material to one another, said seam formed with a flatlock stitch, said seam separate from said open ends of said foot and heel engaging portions and extending along a significant portion of a length of said first material;

a plurality of discrete slip resistant regions formed from a second material, said plurality of slip resistant regions positioned on said bottom of said body such that said first material underlies said plurality of slip resistant regions;

wherein said first material and said second material are different, said first material being formed from a combination of spandex and at least one of polyester or nylon and said second material being formed at least partially from a polymer, said plurality of discrete slip resistant regions being separated from each other along the bottom of the sock body by areas of said resiliently stretchable first material thereby enabling the bottom of the sock to stretch longitudinally and laterally; and said water sock being resistant to the accumulation of significant amounts of water.

2. The water sock of claim 1, wherein said plurality of slip resistant regions are positioned on said ball region and said heel region of said elongate body.

3. The water sock of claim 1, wherein said first material is formed from about ninety percent polyester.

4. The water sock of claim 1, wherein said first material is formed from about ten percent spandex.

5. The water sock of claim 1, wherein said first material is formed from at least sixty-five percent nylon and at least ten percent spandex.

6. The water sock of claim 5, wherein said first material is formed from substantially eighty-five percent nylon and fifteen percent spandex.

7. The water sock of claim 1, wherein said plurality of slip resistant regions are formed from a fabric coated with polyvinyl chloride, said fabric including substantially fifty percent cotton and substantially fifty percent polyester.

8. The water sock of claim 1, wherein said plurality of slip resistant regions have thicknesses of less than or equal to 1/16 inch.

9. The water sock of claim 1, wherein said first material has an amount of stretch between 25 and 40 percent.

10. The water sock of claim 1, wherein said plurality of slip resistant regions further include a grit material.

11. The water sock of claim 1, wherein said at least one seam includes a stretchable thread.

12. The water sock of claim 1, wherein said first material includes at least one opening therethrough, said at least one opening separate from said open ends of said foot and heel engaging portions, said at least one opening formed in said first material by sewing, stitching or knitting.

* * * * *